US007695311B2

(12) United States Patent
Nemoto

(10) Patent No.: US 7,695,311 B2
(45) Date of Patent: Apr. 13, 2010

(54) CONNECTOR

(75) Inventor: Takashi Nemoto, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 12/425,673

(22) Filed: Apr. 17, 2009

(65) Prior Publication Data

US 2009/0269968 A1 Oct. 29, 2009

(30) Foreign Application Priority Data

Apr. 23, 2008 (JP) ..... 2008-111946

(51) Int. Cl.
*H01R 12/24* (2006.01)

(52) U.S. Cl. ..... 439/495

(58) Field of Classification Search ..... 439/495, 439/491, 260

See application file for complete search history.

(56) References Cited

U.S. PATENT DOCUMENTS 6,524,124 B2 * 2/2003 Yamane ..... 439/260
6,755,682 B2 * 6/2004 Kunishi et al. ..... 439/495
2003/0087544 A1 * 5/2003 Nogawa et al. ..... 439/260

FOREIGN PATENT DOCUMENTS

JP 3089464 B2 7/2000

* cited by examiner

*Primary Examiner*—Phuong K Dinh
(74) *Attorney, Agent, or Firm*—Frishauf, Holtz, Goodman & Chick, P.C.

(57) ABSTRACT

A connector which is improved in electrical characteristics thereof. A plurality of contacts which are held in a housing of the connector where an FPC is inserted include at least three supporting contacts each having a supporting portion that pivotally supports an operating member. The operating member is provide with conduction portions for electrically connecting the supporting portions of the supporting contacts and a ground pattern formed on an upper surface of the FPC.

16 Claims, 14 Drawing Sheets

CONNECTOR

BACKGROUND OF THE INVENTION

1. Field of the Invention

This invention relates to a connector, and more particularly to a connector which connects a plate-like object to be connected, such as an FPC (Flexible Printed Circuit) or an FFC (Flexible Flat Cable), to a printed circuit board or the like.

2. Description of the Related Art

Conventionally, there has been proposed a connector comprised of a housing, holddowns, a plurality of contacts, and a pivotally-movable member (see Japanese Patent Publication No. 3089464, Paragraphs 0020 to 0024, FIG. 6).

The housing has an opening which receives one end of a flexible cable.

The holddowns are each formed of a metal plate having an electrical conductivity, and are attached to opposite side walls of the housing, respectively. By soldering the holddowns to pads on a printed circuit board, the connector is fixed to the printed circuit board. The pads to which the holddowns are soldered lead to ground of the printed circuit board.

The contacts are arranged side by side in the housing in a predetermined direction. Each contact includes a contact portion, a terminal portion, and a pivot portion. The contact portion is at a front end of a lower part of the contact, as viewed in FIG. 6 of the above-mentioned publication, and is brought into contact with a conductor pattern on a lower surface of the flexible cable which is inserted in the opening. The terminal portion is at a rear end of the lower part of the contact, and is connected to the printed circuit board. The pivot portion is engaged with a recess of the pivotally-movable member to rotatably support the pivotally-movable member.

The pivotally-movable member is comprised of a pivotally-movable member main body and a shell. The pivotally-movable member main body is made of an insulating material. The shell is made of a conductive material having elasticity, and covers the pivotally-movable member main body. The shell has contact portions formed at opposite ends thereof. When the pivotally-movable member closes the opening of the housing, the shell is brought into contact with a shield on the upper surface of the flexible cable which is inserted in the opening, and the contact portions of the shell are brought into contact with the holddowns, respectively.

To connect the flexible cable to the printed circuit board using the above-described connector, first, the pivotally-movable member is rotated to open the opening of the housing.

Next, one end of the flexible cable is inserted into the opening of the housing.

Finally, the pivotally-movable member is rotated to close the opening of the housing. At this time, the conductor pattern on the lower surface of the flexible cable is electrically connected to a conductor pattern on the printed circuit board via the contacts, and the shield on the upper surface of the flexible cable is electrically connected to a ground pattern on the printed circuit board via the shell and the holddowns.

In the above-described connector, the shield on the upper surface of the flexible cable is electrically connected to the ground pattern on the printed circuit board via the holddowns located at the opposite ends of the housing.

Although the contacts which are close to the opposite ends of the housing are also close to the holddowns, the contacts which are located at an intermediate portion of the housing are far from the holddowns, so that the electrical characteristics of the connector are degraded as a whole.

SUMMARY OF THE INVENTION

The present invention has been made in view of these circumstances, and an object thereof is to provide a connector which is improved in electrical characteristics thereof.

To attain the above object, the present invention provides a connector comprising a plurality of contacts each including a contact portion which is brought into contact with a first conductor pattern formed on one surface of one object to be connected, the one object having a plate-like shape, and a connection portion which is connected to another object to be connected, the other object having a plate-like shape, the plurality of contacts including at least three supporting contacts each having a supporting portion, a housing that holds the plurality of contacts, and has the one object to be connected inserted therein, and an operating member pivotally supported by the supporting portions of the at least three supporting contacts, for pushing the first conductor pattern of the one object to be connected which is inserted in the housing to the contact portions of the plurality of contacts, the operating member having conduction portions provided thereon for electrically connecting the supporting portions and a second conductor pattern formed on the other surface of the one object to be connected.

With the arrangement of the connector according to the present invention, since the plurality of contacts include at least three supporting contacts each having the supporting portion which pivotally supports the operating member, and the conduction portion which electrically connects the supporting portion of each of at least three supporting contacts and the second conductor pattern which is formed on the other surface of one object to be connected is provided on the operating member, there are secured more than two paths from the second conductor pattern of the one object to be connected to the ground of the other object to be connected. This makes it possible to reduce the difference between the distance from a position on the second conductor pattern of the one object to be connected in the contact arranging direction to the ground of the other object to be connected, and the distance from another position on the second conductor pattern of one object to be connected in the contact arranging direction to the ground of the other object to be connected.

Preferably, two supporting contacts of the at least three supporting contacts are disposed at opposite ends of the operating member in a longitudinal direction thereof, and others of the supporting contacts are disposed between the two supporting contacts.

Preferably, the operating member has a metal plate disposed on a surface thereof opposed to the one object to be connected, and the conduction portions and the metal plate are integrally formed.

Preferably, the supporting contacts is larger in number than the conduction portions.

Preferably, the connector comprises an inserted state recognition member including a spring portion, a fixing portion which is continuous with the spring portion, and is fixed to the housing, and a swing portion which is located on a path of insertion of the one object to be connected, for being swung upward by the one object to be connected when the one object to be connected is inserted in the housing against an urging force of the spring portion, and returning to an original position via an empty space formed in the one object to be connected when the one object to be connected is completely inserted.

More preferably, at least the swing portion of the inserted state recognition member is positioned at an end of the operating member in a longitudinal direction, where the inserted state recognition member is visible from the outside of the housing.

According to this invention, there are secured more than two paths from the second conductor pattern which is formed on the other surface of the one object to be connected to the ground of the other object to be connected, and it is possible to reduce the difference between the distance from one position on the second conductor pattern of the one object to be connected in the contact arranging direction to the ground of the other object to be connected, and the distance from another position on the second conductor pattern of the one object to be connected in the contact arranging direction to the ground of the other object to be connected. Therefore, it is possible to improve the electrical characteristics of the connector, and prevent the transmission characteristics of signals from being degraded.

The above and other objects, features and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

Figure 1:
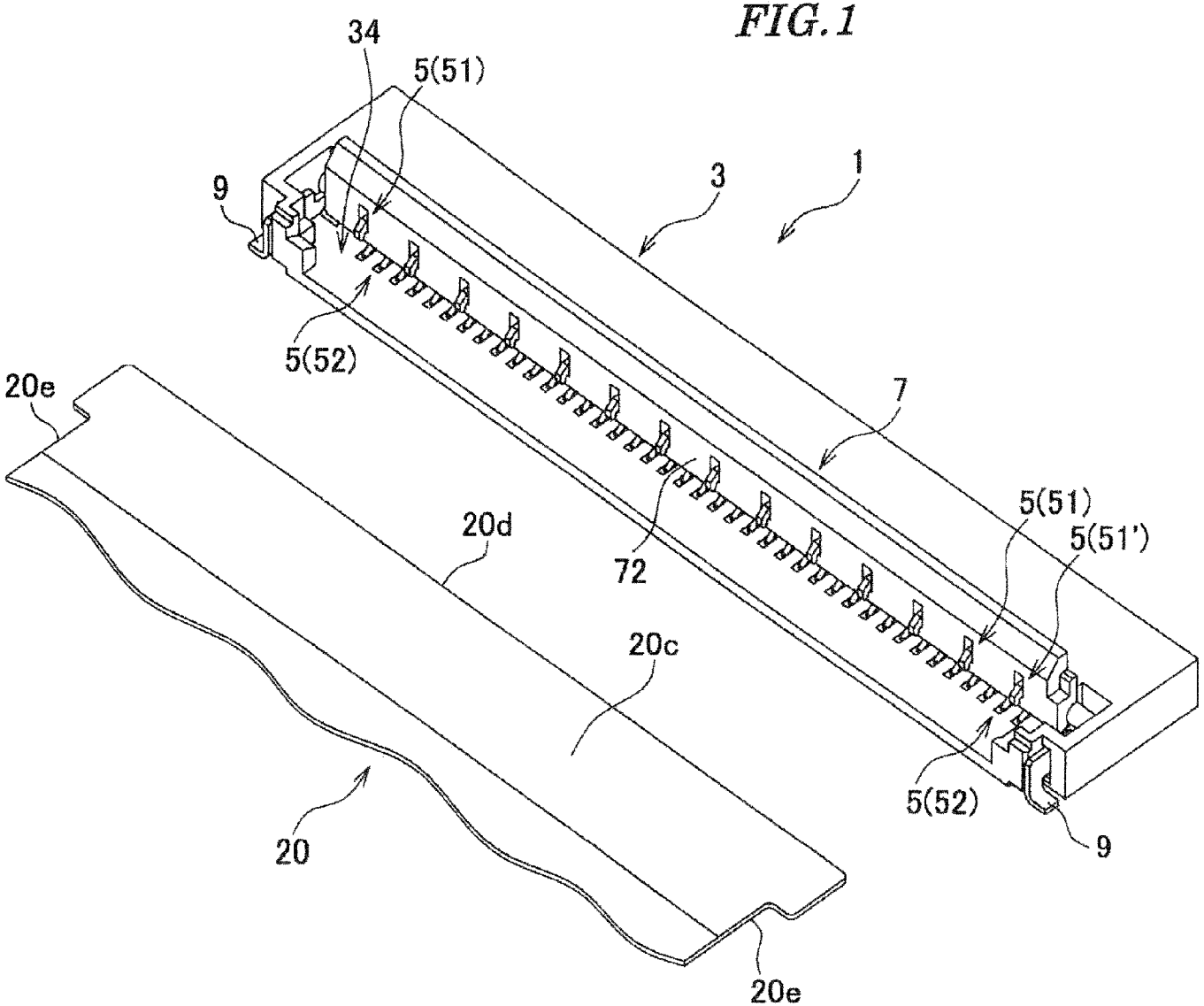
FIG. 1 is a perspective view of a connector according to a first embodiment of the present invention in a state in which an FPC is not connected thereto.
Figure 2:
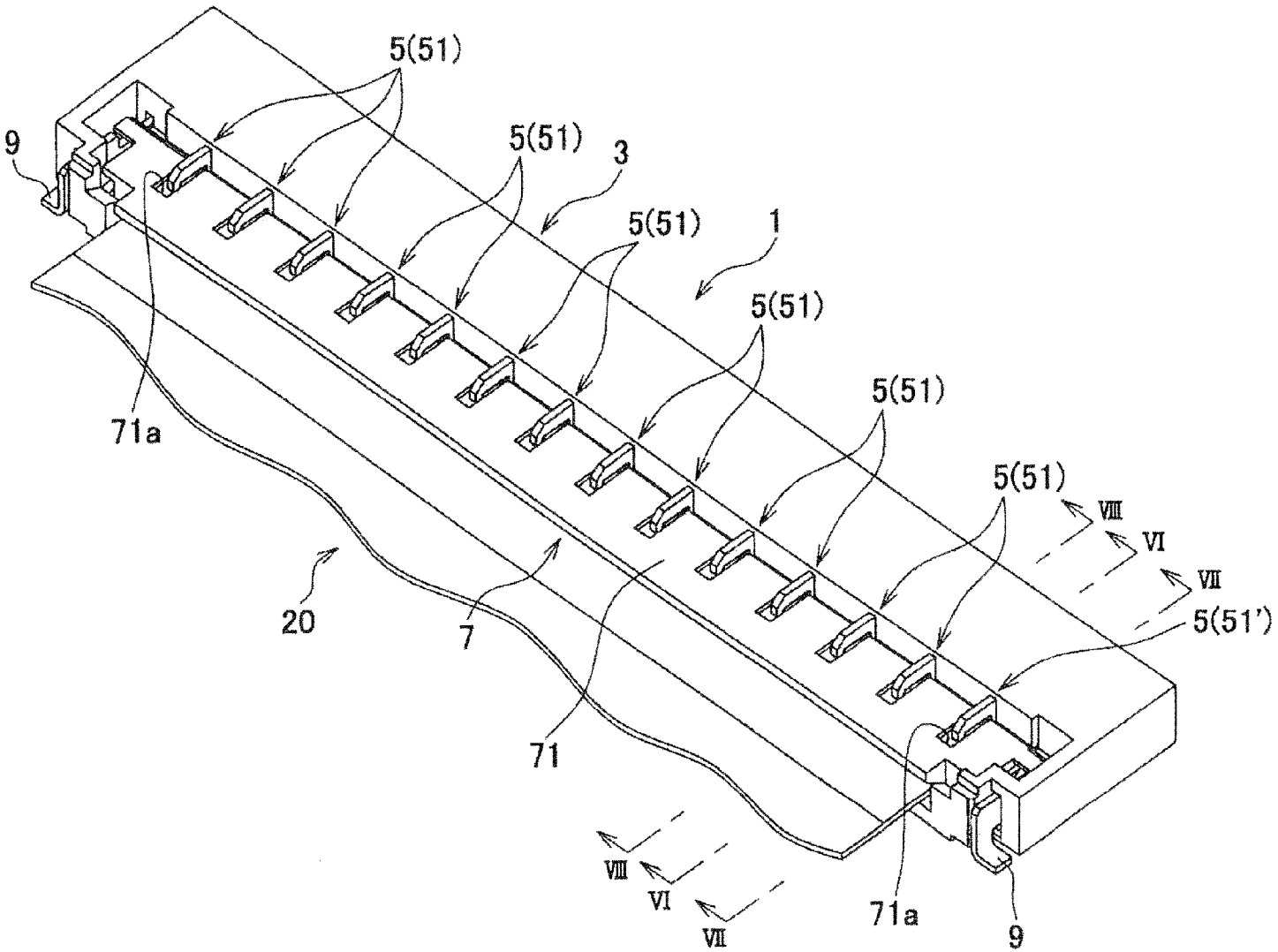
FIG. 2 is a perspective view of the connector shown in FIG. 1 in a state in which the FPC is connected thereto.

As shown in FIGS. 1 and 2, a connector 1 is comprised of a housing 3, a plurality of contacts 5, an operating member 7, and holddowns 9. The connector 1 electrically connects an FPC (Flexible Printed Circuit) 20 (one object to be connected having a plate-like shape) and a printed circuit board (the other object to be connected), not shown.

Figure 3:
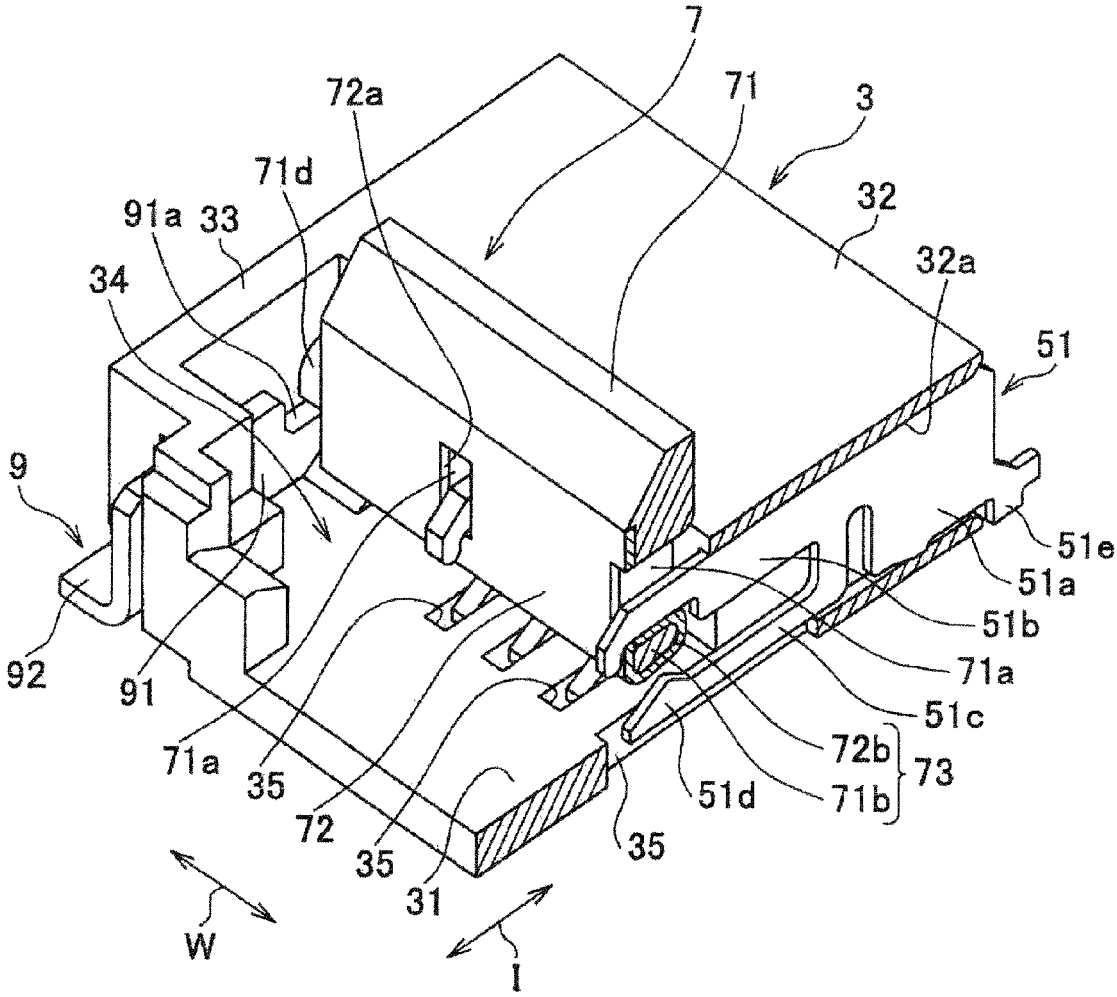
FIG. 3 is a view showing a cross-section of a supporting contact and its surroundings of the connector in the state shown in FIG. 1.
Figure 4:
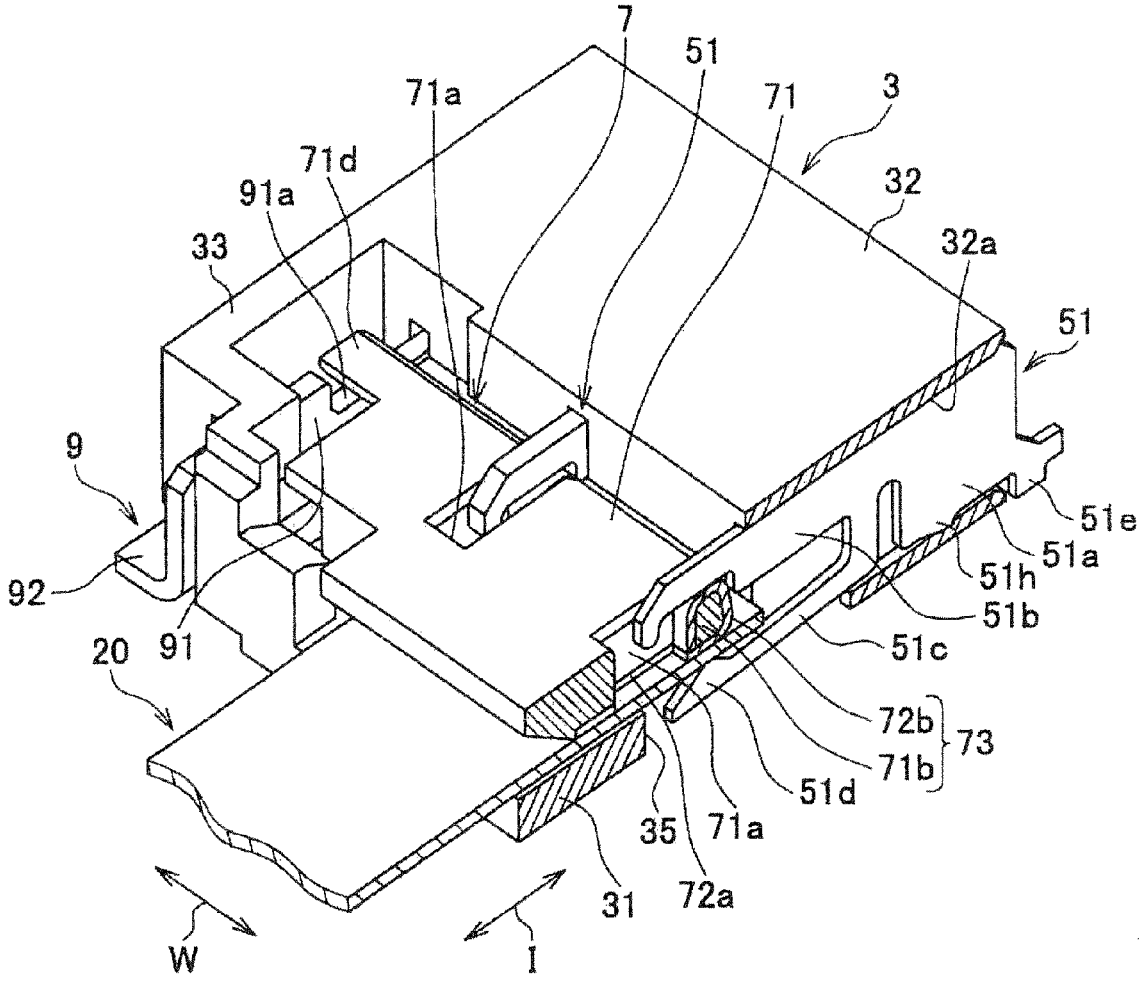
FIG. 4 is a view showing a cross-section of the supporting contact and its surroundings of the connector in the state shown in FIG. 2.
Figure 5:
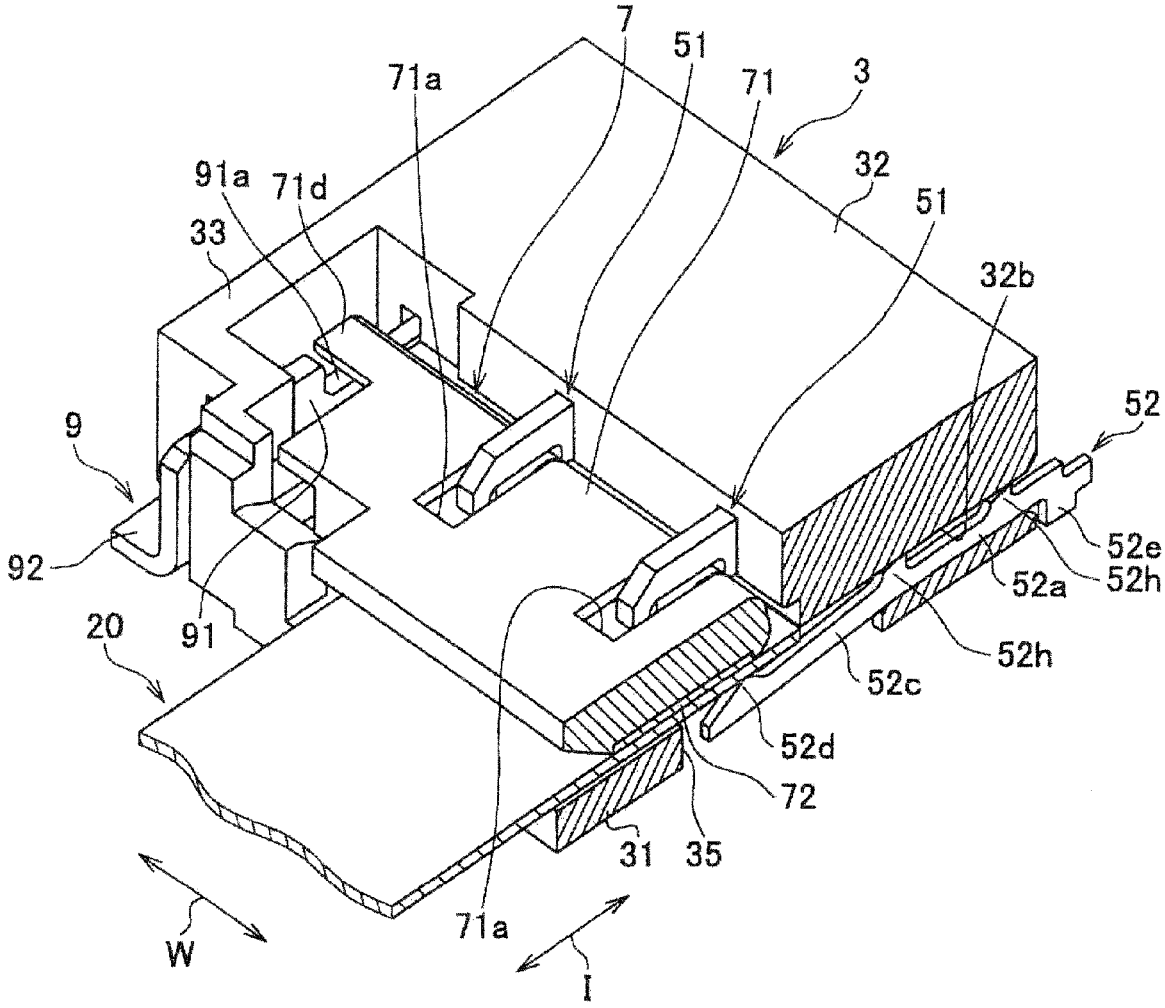
FIG. 5 is a view showing a cross-section of a high-speed transmission signal contact and its surroundings of the connector in the state shown in FIG. 1.

As shown in FIGS. 3 to 5, the housing 3 includes a thin portion 31, a thick portion 32, and side-wall portions 33, and is made of an insulating material. The thin portion 31 has a thin plate-like shape. The thick portion 32 has a thick plate-like shape, and a rear portion of the thick portion 32 and a rear portion of the thin portion 31 are continuous to each other. Each side-wall portion 33 is continuous to opposite sides of the thin portion 31 and the thick portion 32. A space in a front portion of the housing 3, which is defined by the thin portion 31, the thick portion 32, and the side-wall portions 33, is an accommodation space 34.

The thick portion 32 has a plurality of contact accommodating holes 32*a* and 32*b* formed therein along a direction W of the width of the housing 3 at equally-spaced intervals. The contact accommodating holes 32*a* and 32*b* extend in an inserting/removing direction I of the FPC 20 into/from the connector 1, and communicate with the accommodation space 34. In the contact accommodating holes 32*a*, supporting contacts 51, referred to hereinafter, are accommodated. In the contact accommodating holes 32*b*, high-frequency transmission signal contacts 52, referred to hereinafter, are accommodated. Each two contact accommodating holes 32*b* are disposed between each two contact accommodating holes 32*a*.

A plurality of window holes 35 are formed in an intermediate portion of the thin portion 31. The window holes 35 extend in the inserting/removing direction I. Front portions of the window holes 35 communicate with the accommodation space 34, and rear portions of the window holes 35 communicate with the contact accommodating holes 32*a* or the contact accommodating holes 32*b*.

Figure 6:
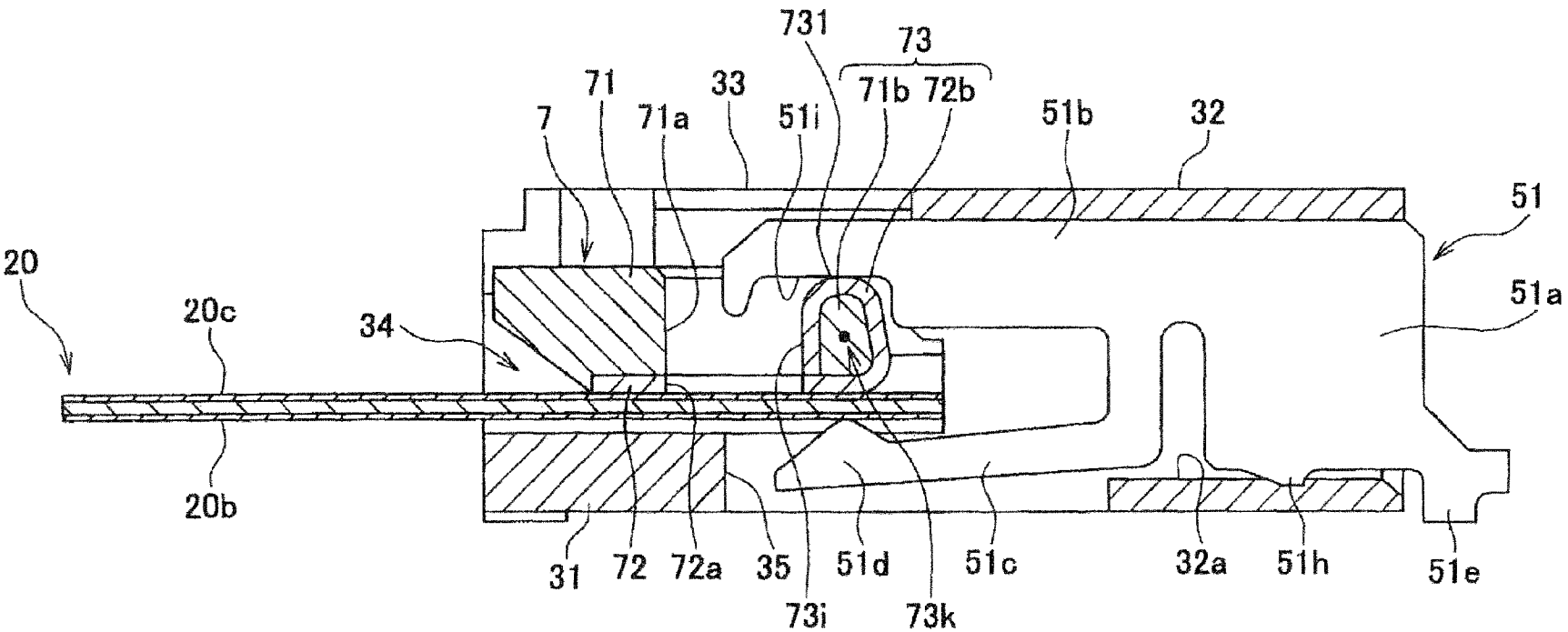
FIG. 6 is a cross-sectional view taken on line VI-VI of FIG. 2.
Figure 7:
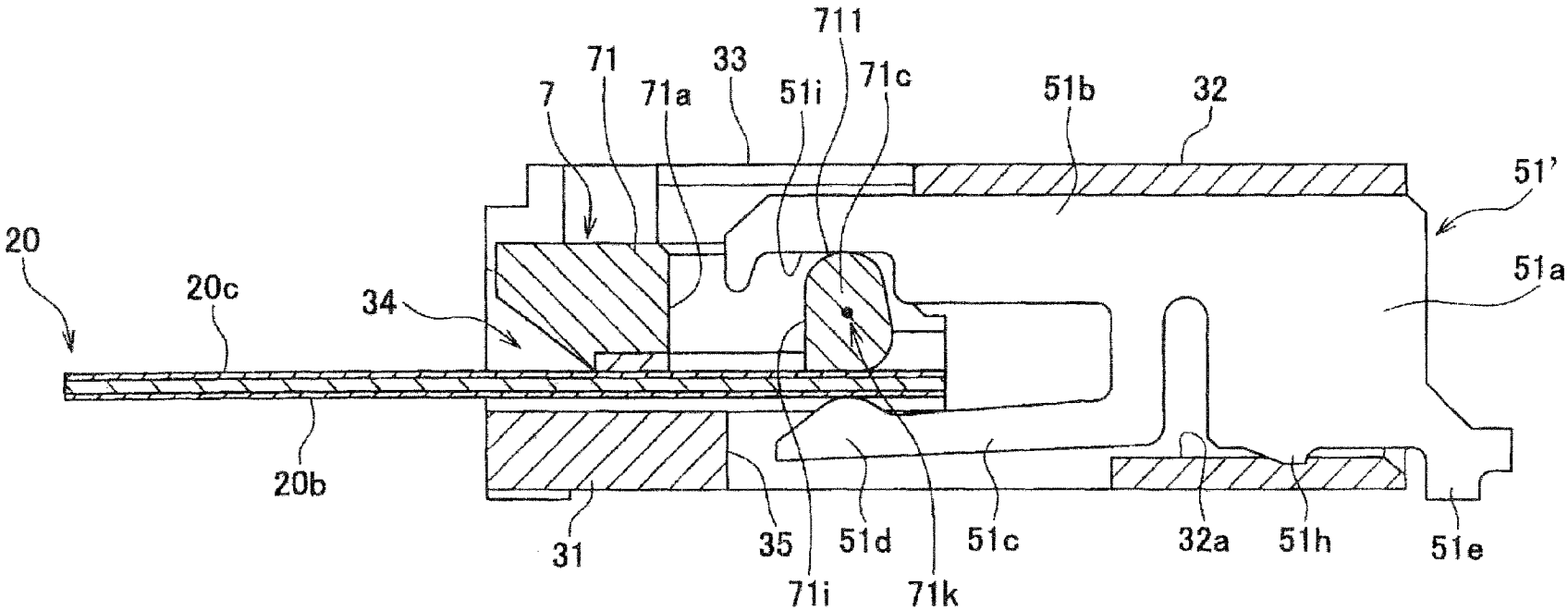
FIG. 7 is a cross-sectional view taken on line VII-VII of FIG. 2.

As shown in FIGS. 5 to 7, the contacts 5 are classified into the supporting contacts 51 and the high-frequency transmission signal contacts 52.

Each supporting contact 51 includes a fixing portion 51*a*, a supporting portion 51*b*, a spring portion 51*c*, a contact portion 51*d*, and a terminal portion (connection portion) 51*e*. The fixing portion 51*a* has a protrusion 51*h*. The fixing portion 51*a* is press-fitted in the accommodation hole 32*a*, thereby being fixed to the housing 3. The supporting portion 51*b* is continuous with the fixing portion 51*a*. The supporting portion 51*b* has a recess 51*i* formed in a front end thereof. The spring portion 51*c* is substantially L-shaped, and is continuous with the supporting portion 51*b*. The contact portion 51*d* is continuous with the spring portion 51*c*. The contact portion 51*d* and part of the spring portion 51*c* are accommodated in the window hole 35.

The high-frequency transmission signal contact 52 is a contact specialized for high-frequency transmission, and has a linear shape without the supporting portion 51*b* or the like which can be a stub. The high-frequency transmission signal contact 52, as shown in FIG. 5, includes a fixing portion 52*a*, a spring portion 52*c*, a contact portion 52*d*, and a terminal portion (connection portion) 52*e*. The fixing portion 52*a* has a protrusion 52*h*. The fixing portion 52*a* is press-fitted in the accommodation hole 32*b*, thereby being fixed to the housing 3. The spring portion 52*c* is continuous with the fixing portion 52*a*. The contact portion 52*d* is continuous with the spring portion 52*c*. The contact portion 52*d* and part of the spring portion 52*c* are accommodated in the window hole 35. Each two high-frequency transmission signal contacts 52 which are sandwiched by the adjacent supporting contacts 51 form a differential transmission pair.

As shown in FIGS. 2 to 8, the operating member 7 includes an operating member main body 71 and a shield plate (metal plate) 72. The operating member main body 71 is formed of a resin and has a long plate-like shape. The operating member main body 71 has long holes 71*a* formed therein in a longitudinal direction thereof at equally-spaced intervals. The spacing between the long holes 71*a* is equal to the spacing between the supporting contacts 51 disposed in the housing 3. Each long hole 71*a* receives a front end of the supporting portion 51*b* of the associated supporting contact 51.

The operating member main body 71 has a cam central portion 71*b* formed at a location toward one end of each long hole 71*a* (toward a rotational axis of the operating member 7) (see FIG. 6), except for the long hole 71*a* located at a right end of the operating member main body 71 as viewed in FIG. 2 (since the contact for high-frequency transmission is not disposed at the right end).

The operating member main body 71 has a cam 71*c* formed at a location toward one end of the long hole 71*a* (toward the rotational axis of the operating member 7) at the right end of the operating member main body 71 as viewed in FIG. 2 (see FIG. 7). The cam 71*c* has an outer diameter larger than that of the cam central portion 71*b*. The operating member 71 has pivot portions 71*d* formed at the opposite ends thereof.

The shield plate 72 is formed of a metal plate, and covers a surface of the operating member main body 71 which is opposed to a ground pattern 20*c* of the FPC 20. The shield plate 72 has window holes 72*a* formed therein at equally-spaced intervals. Each window hole 72*a* has a rectangular shape in plan view, and is opposed to the long hole 71*a* when the shield plate 72 is mounted on the operating member main body 71. The shield plate 72 has a plurality of conduction portions 72*b*. Each conduction portion 72*b* is wound around the cam central portion 71*b*. The conduction portion 72*b* has a belt-like shape when developed into a flat state. Each conduction portion 72*b* is adjacent to the window hole 72*a*. However, the conduction portion 72*b* is not adjacent to the window hole 72*a* toward the one end of the shield plate 72 located at the right end as viewed in FIG. 2. The cam central portion 71*b* and the conduction portion 72*b* wound therearound form a conduction cam 73. The conduction cam 73 has the same shape and size as those of the cam 71*c*.

By supporting the conduction cams 73 and the cam 71*c* in the recesses 51*i* of the supporting portions 51*b*, and supporting the pivot portions 71*d* in recesses 91*a*, referred to hereinafter, the operating member 7 is pivotally supported. Therefore, the operating member 7 is capable of pivoting about the conduction cams 73 and the cam 71*c* between an open position shown in FIG. 3 (position in which the shield plate 72 is substantially perpendicular to the upper surface of the thin portion 31) and a closed position shown in FIG. 4 (position in which the shield plate 72 is substantially parallel to the upper surface of the thin portion 31).

The holddowns 9 are each formed of a metal plate. Each holddown 9 includes a holddown main body 91 and a leg portion 92. The holddown main body 91 has the recess 91*a*, and is fixed to each side-wall portion 33 of the housing 3. The holddown main body 91 has a portion projecting into the accommodation space 34, and the recess 91*a* is disposed within the accommodation space 34. The recess 91*a* pivotally supports the pivot portion 71*d* of the operating member 7. The leg portion 92 is continuous with the holddown main body 91, and is soldered to a pad on the printed circuit board. As a result, the connector 1 is fixed to the printed circuit board.

To connect the FPC 20 to the connector 1, first, as shown in FIGS. 1 and 3, the operating member 7 is rotated to the open position to permit insertion of the FPC 20 into the accommodation space 34. At this time, the recess 51*i* of the supporting portion 51*b* of each supporting contact 51 is brought into contact with a part 73*i* of the conduction cam 73 which is close to a center 73*k* of the cam surface of thereof (see FIG. 6), and the recess 51*i* of the supporting portion 51*b* of a supporting contact 51' at the right end as viewed from the side of the accommodation space 34 of the housing 3 is brought into contact with a part 71*i* of the cam 71*c* which is close to a center 71*k* of the cam surface thereof (see FIG. 7).

Next, a front end 20*d* of the FPC 20 is inserted into the accommodation space 34.

Then, as shown in FIGS. 2 and 4, the operating member 7 is pivoted to the closed position. At this time, the respective recesses 51*i* of the supporting portions 51*b* of the supporting contacts 51 are brought into contact with parts 73*l* and 71*l* which are far from the centers 73*k* and 71*k* of the conduction cams 73 and the cam 71*c*, respectively, whereby the operating member 7 pushes downward the spring portions 51*c* and 52*c* of the supporting contacts 51 and the high-frequency transmission signal contacts 52 against the spring forces of the spring portions 51*c* and 52*c* (see FIGS. 6 and 7).

Figure 8:
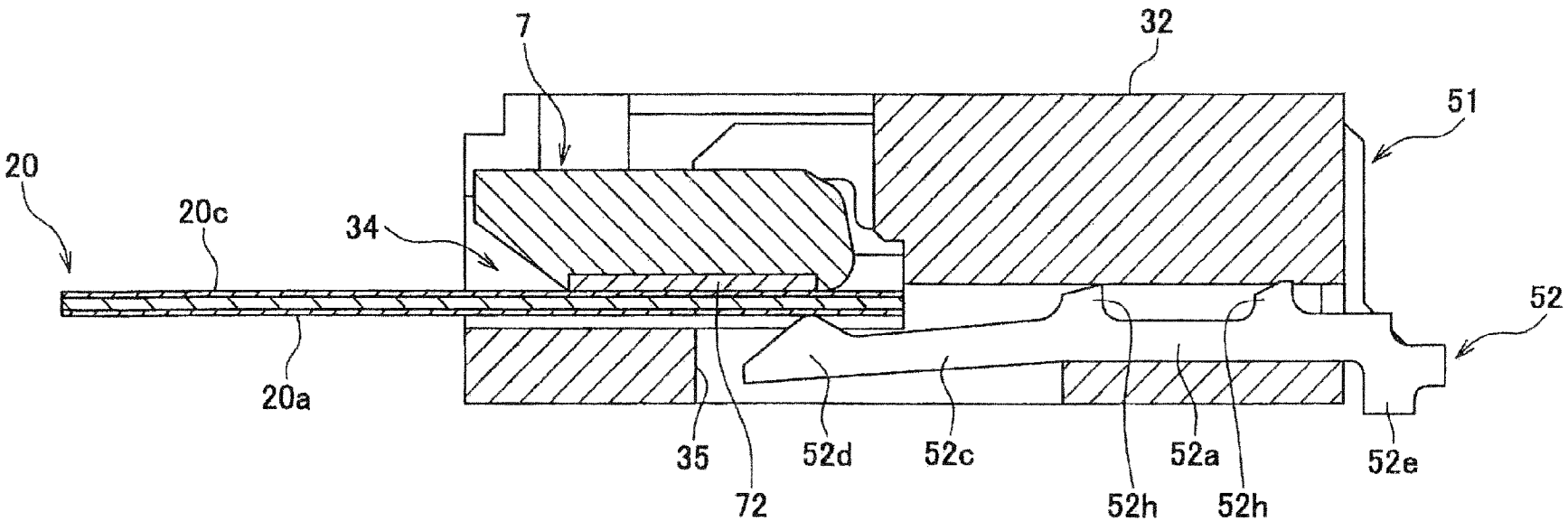
FIG. 8 is a cross-sectional view taken on line VIII-VIII of FIG. 2.
Figure 9:
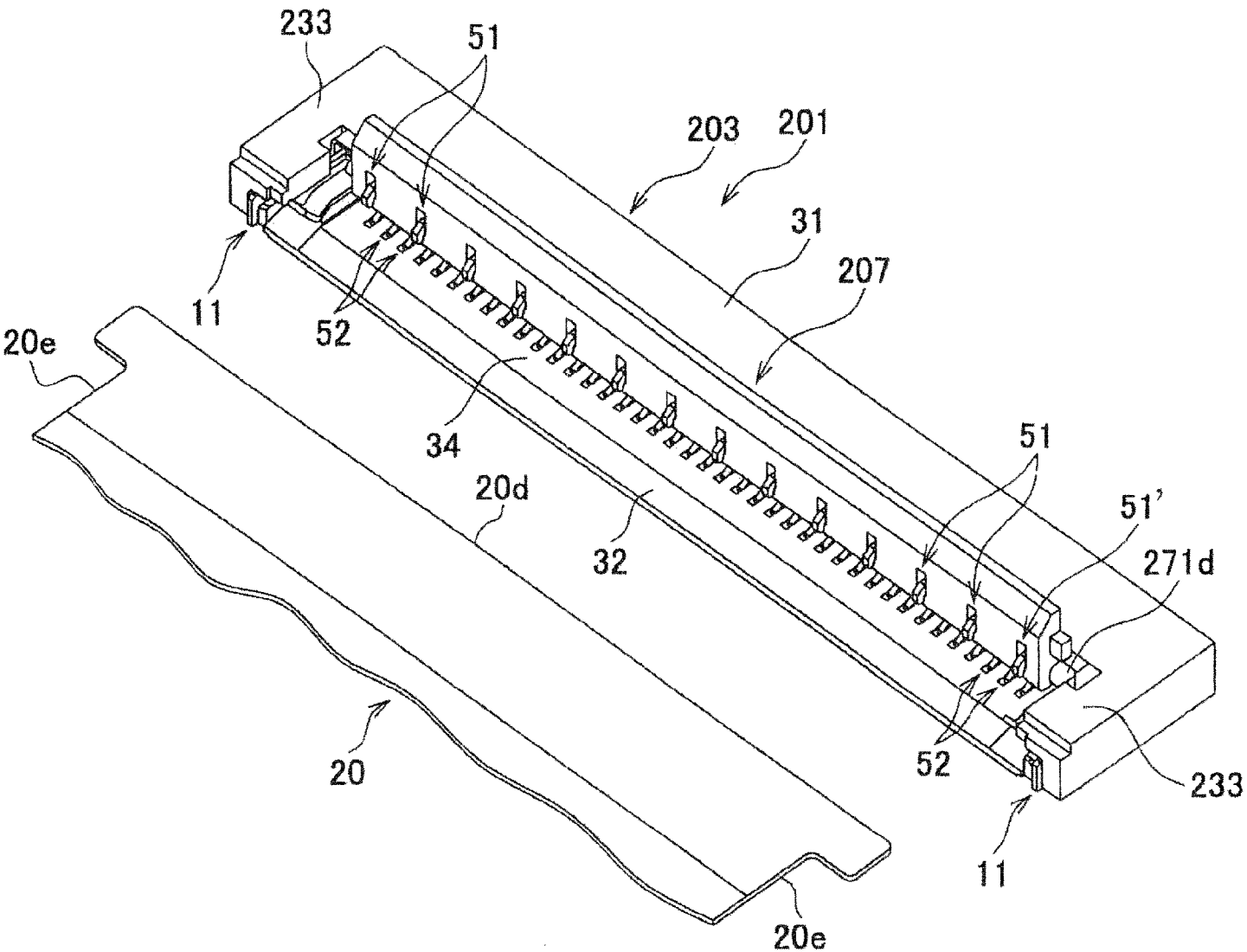
FIG. 9 is a perspective view of a connector according to a second embodiment of the present invention in a state in which an FPC is not connected thereto.
Figure 10:
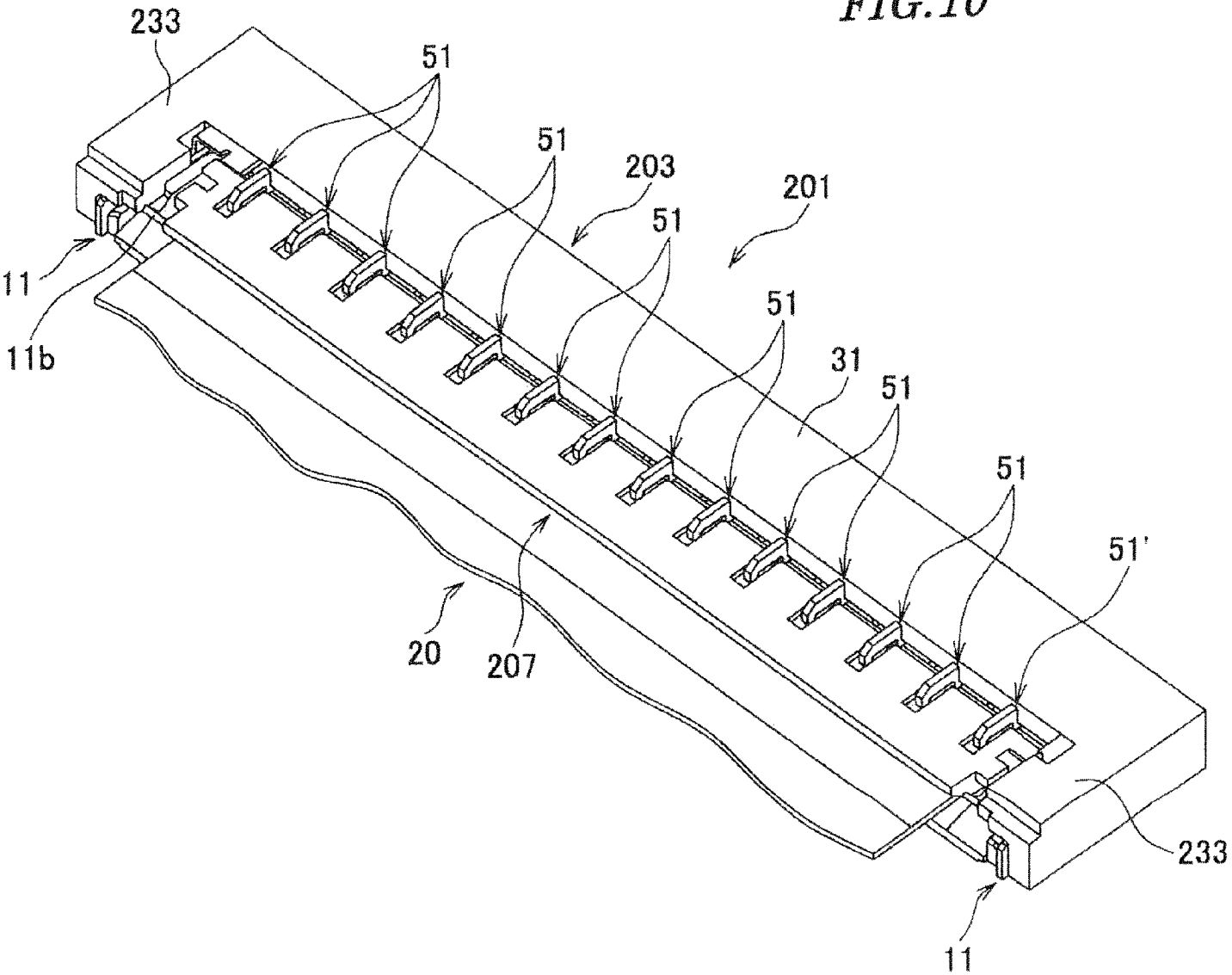
FIG. 10 is a perspective view of the connector shown in FIG. 9 in a state in which the FPC is connected thereto.

When the spring portions 51*c* and 52*c* are pushed downward, the restoring forces of the spring portions 51*c* and 52*c* cause the contact portions 51*d* of the supporting contacts 51 engaged with the conduction cams 73 to be brought into firm contact with a high-frequency transmission ground pattern (first conductor pattern) 20*b* which is formed on a lower surface of the FPC 20 (see FIG. 6), the contact portion 51*d* of the supporting contact 51 which is engaged with the cam 71*c* to be brought into firm contact with the high-frequency transmission ground pattern (first conductor pattern) 20*b* which is formed on the lower surface of the FPC 20 (see FIG. 7), and further the contact portions 52*d* of the high-frequency transmission signal contacts 52 to be brought into firm contact with a high-frequency transmission signal pattern (first conductor pattern) 20*a* which is formed on the lower surface of the FPC 20 (see FIG. 8).

Further, the shield plate 72 is brought into contact with the ground pattern (second conductor pattern) 20*c* which is formed on an upper surface of the FPC 20 (see FIG. 6). At this time, the ground pattern 20*c* of the FPC 20 is electrically connected to the ground of the printed circuit board (not shown) via the conduction portions 72*b* of the shield plate 72 and the supporting contacts 51.

Since the signal pattern 20*a* and the ground pattern 20*b* have the same shape, these are defined as the first conductor patterns. It is to be understood that the signal pattern 20*a* and the ground pattern 20*b* may have different shapes.

The connector 1 according to the present embodiment provides the following advantageous effects:

The plurality of contacts 5 include at least three supporting contacts 51 each having the supporting portion 51*b* for pivotally supporting the operating member 7, and the conduction portions 72*b* that electrically connect between the supporting portions 51*b* of the at least three supporting contacts 51 and the ground pattern 20*c* of the FPC 20 are provided on the operating member 7. Therefore, more than two paths from the ground pattern 20*c* of the FPC 20 to the ground on the printed circuit board are secured. As a result, there is little difference between the distance from an end portion of the ground pattern 20*c* of the PFC 20 in the contact arranging direction W to the ground on the printed circuit board and the distance from an intermediate portion of the ground pattern 20*c* of the FPC 20 in the contact arranging direction W to the ground on the printed circuit board. Further, there is little difference between the distance from a signal contact 52 at an end location in the contact arranging direction W to the ground of the printed circuit board, and a signal contact 52 at an intermediate location in the contact arranging direction W to the ground of the printed circuit board. Therefore, it is possible to prevent the transmission characteristics of high-frequency signal from being degraded.

Further, in the above-described embodiment, the cam 71*c* is formed toward one end of the long hole 71*a* located at the right end of the operating member main body 71 as viewed in FIG. 2 (see FIG. 7), and the cam central portion 71*b* is formed toward one end of each long hole 71*a* other than the long hole 71*a* located at the right end of the operating member main body 71 (see FIG. 6), with the conduction portion 72*b* wound around the cam central portion 71*b*. However, it is possible to determine which long holes 71*a* of the operating member main body 71 are to be formed with the cam central portion 71*b* toward one end thereof, the conduction portion 72*b* wound therearound, as required. Therefore, it is possible to arrange paths from the ground pattern 20*c* of the FPC 20 to the ground on the printed circuit board, as required.

Further, since there are ground contacts (not shown) between the high-frequency transmission signal contacts 52 of each adjacent differential transmission pair, it is possible to prevent crosstalk from occurring between the high-frequency transmission signal contacts 52 of the adjacent differential transmission pair.

Further, since the operating member 7 has the shield plate 72, it is possible to prevent noise from propagating to the outside of the connector, or from invading from the outside of the connector.

Furthermore, since it is possible to electrically connect the ground pattern 20*b* on the lower surface of the FPC 20 and the ground pattern 20*c* on the upper surface of the FPC 20 via the conduction portions 72 and the supporting contacts 51, it is not necessary to provide through holes or vias.

In the above-described conventional connector, since one shell provided on the pivotally-movable member is brought into contact with the upper surface of the flexible cable, it is only possible to electrically connect the shield formed on the upper surface of the flexible cable to the ground of the printed circuit board via one shell provided on the pivotally-movable member and the holddowns located at the opposite sides of the housing. However, in the embodiment according to the present invention, the plurality of conduction portions 72*b* provided on the operating member main body 71 are brought into contact with the upper surface of the FPC 20. This makes it possible to electrically connect one ground pattern 20*c* formed on the whole upper surface of the FPC 20 to the ground of the printed circuit board via the plurality of conduction portions 72*b* provided on the operating member main body 71 and the plurality of supporting contacts 51. Therefore, instead of one ground pattern 20*c* being formed on the upper surface of the FPC 20, even if a plurality of signal patterns (not shown) are formed, if only the shield plate 72 (ground pattern 20*c*) is removed from the operating member 7, leaving a plurality of conduction portions 72*b* not removed, the connector can be used for the FPC having signal patterns on the opposite sides thereof (variation of the first embodiment).

Now, a connector according to a second embodiment of the present invention will be described with reference to FIGS. 9 to 14.

Component parts identical to those of the connector according to the first embodiment are denoted by identical reference numerals, and detailed description thereof is omitted, while only main component parts different in construction from those of the first embodiment will be described hereinafter.

As shown in FIGS. 9 to 12, in the connector 201 according to the second embodiment, inserted state recognition members 11 are employed so as to make it possible to confirm an inserted state of the FPC 20.

Each side-wall portion 233 of a housing 203 is formed such that it has a thickness larger than that of each side-wall portion 33 of the housing 3 of the connector 1 according to the first embodiment, so to hold the associated one of the inserted state recognition members 11.

Figure 12:
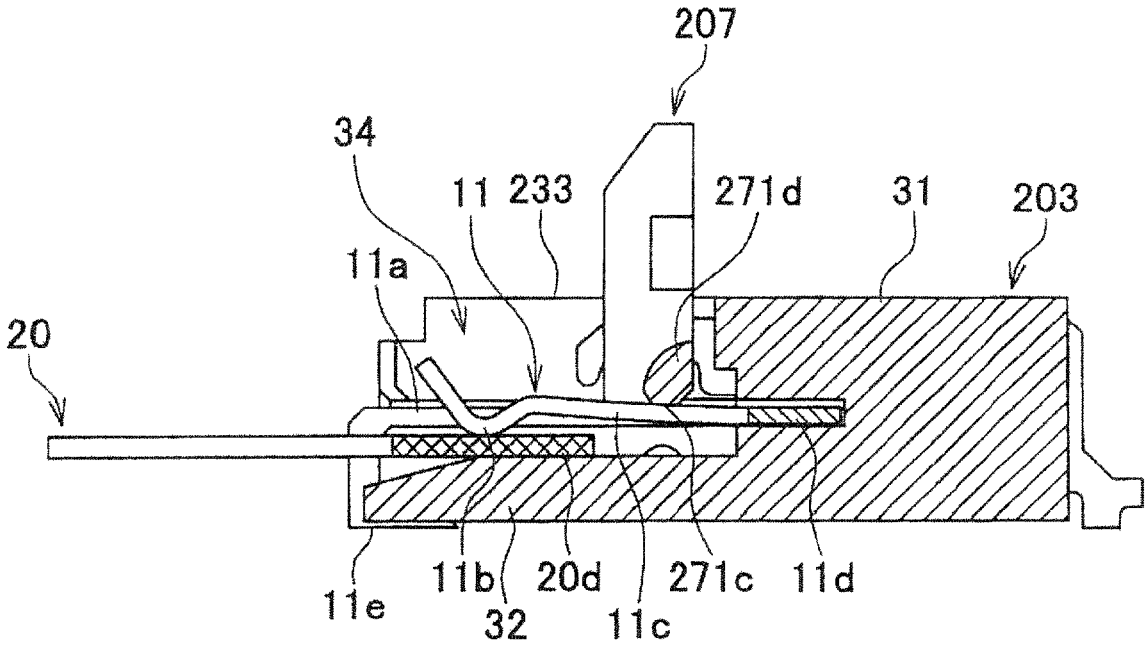
FIG. 12 is a cross-sectional view of the connector shown in FIG. 9 in a state in which the FPC is halfway inserted therein.
Figure 13:
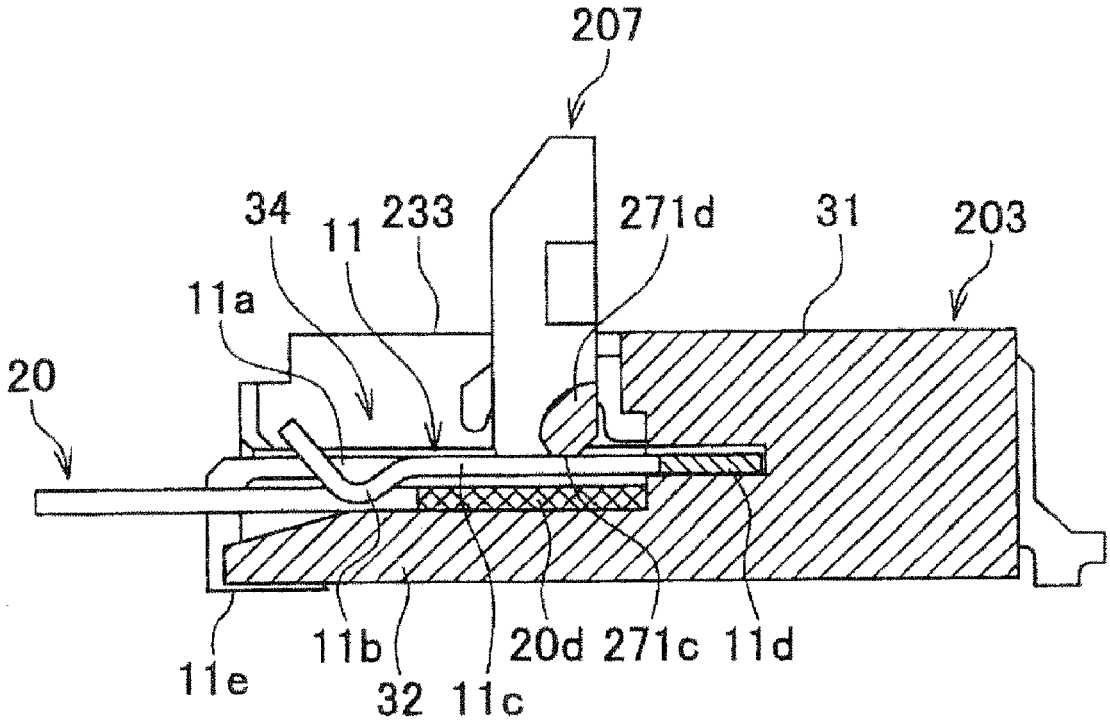
FIG. 13 is a cross-sectional view of the connector shown in FIG. 9 in a state in which the FPC is completely inserted therein.

As shown in FIGS. 12 and 13, an operating member 207 has pivot portions 271*d* formed at opposite ends thereof. Each pivot portion 271*d* has a flat surface 271*c*.

Figure 14:
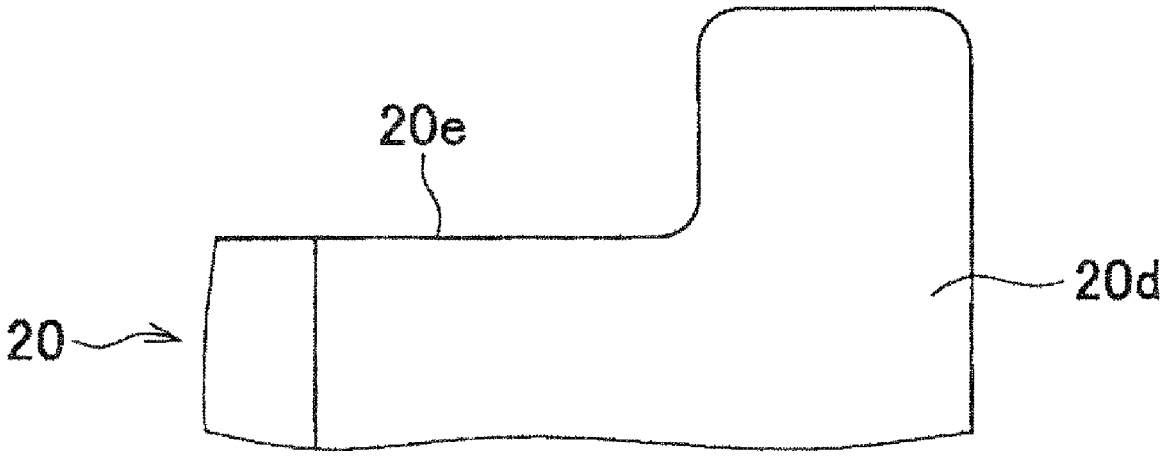
FIG. 14 is a plan view of a front end of the FPC.

As shown in FIG. 14, the FPC 20 has cutouts (voids) 20*e* formed at opposite sides of the FPC 20, except the front end 20*d* of the FPC 20.

Figure 11:
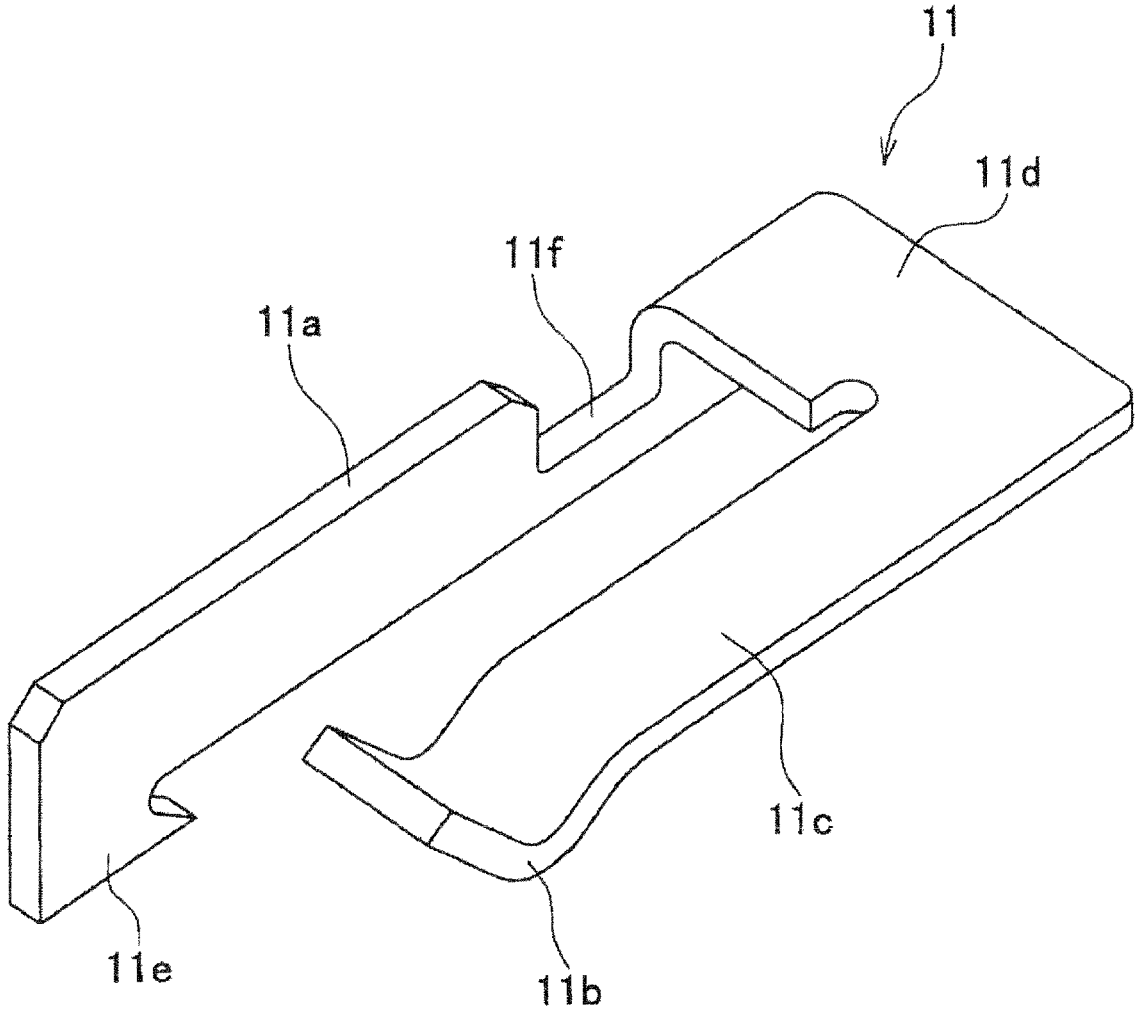
FIG. 11 is a perspective view of an inserted state recognition member of the connector shown in FIG. 9.

As shown in FIG. 11, each inserted state recognition member 11 includes a fixing portion 11*a*, a swing portion 11*b*, a spring portion 11*c*, an linking portion 11*d*, and a soldered portion 11*e*.

The fixing portion 11*a* is held by the side-wall portion 233 of the housing 203. The fixing portion 11*a* is formed with a bearing 11*f* having a concave shape. The bearing 11*f* pivotally supports the pivot portion 271*d* of the operating member 207.

The swing portion 11*b* is dispose on the path of insertion of the FPC 20.

The spring portion 11*c* urges the swing portion 11*b* downward.

The linking portion 11*d* engages the spring portion 11*c* and the fixing portion 11*a*.

The soldered portion 11*e* is soldered to the pad on the printed circuit board. Therefore, the inserted state recognition members 11 also serve as holddowns.

The swing portion 11*b* and the spring portion 11*c* of each inserted state recognition member 11 project into the accommodation space 34. The swing portions 11*b* and the spring portions 11*c* are at the opposite ends of the operating member 207 in the longitudinal direction, and are at locations visible from the outside of the housing 203 (see FIGS. 9 and 10).

As shown in FIG. 12, when the operating member 207 is rotated to the open position, thereby causing the front end 20*d* of the FPC 20 to be inserted into the accommodation space 34 of the housing 203 against the spring force of the spring portions 11*c*, the swing portions 11*b* are flipped upward by the FPC 20 and are once caused to climb onto the front end 20*d* of the FPC 20.

At this time, since the flat surface 271*c* of the pivot portion 271*d* of the operating member 207 is brought into contact with the spring portion 11*c* of the inserted state recognition member 11, the operating member 207 is not rotated to the side of the closed position with ease.

As shown in FIG. 13, when the front end 20*d* of the FPC 20 is completely inserted into the accommodation space 34 of the housing 203, the swing portions 11*b* fall into the cutouts 20*e* from the upper surface of the front end 20*d* of the FPC 20, and return to the original position. At this time, the operator can sense a positive clicking feeling on fingers of this, and at the same time a clicking sound is generated.

The second embodiment not only provides the same advantageous effects as provided by the first embodiment but also makes it possible to recognize whether or not the front end 20*d* of the FPC 20 is correctly inserted by a clicking feeling or a clicking sound, to thereby prevent the FPC 20 from being incorrectly inserted in the connector 201.

Further, the swing portion 11*b* and the spring portion 11*c* of each inserted state recognition member 11 are at a location at each of the opposite ends of the operating member 207 in the longitudinal direction, where they are visible from the outside of the housing 203. Therefore, even if the inserted state cannot be confirmed by feeling a clicking feeling or a clicking sound, it is possible to visually recognize an inserted state of the FPC 20 in the connector 201, to thereby prevent the FPC 20 from being incorrectly inserted into the connector 201. Further, although each cutout 20*e* is given as an example of an empty space, the other example of the empty space includes a hole, or the like.

Although in the above-described embodiment, thirteen conduction portions 72*b* are disposed in the operating member 7, 207 because each pair of high-frequency transmission signal contacts 52 are sandwiched by associated ones of the supporting contacts 51 which are connected to the conduction portions 72*b*, it is only necessary to be provided with at least three conduction portions 72*b* if there is no need to sandwich high-frequency transmission signal contacts 52 by ground patterns 20*b*. When providing three conduction portions 72*b*, one may be disposed at a central portion of the operating member 7, 207, and the other two may be disposed at the opposite ends of the same Further, although the number of the supporting contacts 51 is larger than the number of the conduction portions 72*b* by one since the conduction portions 72*b* provided for only necessary positions, the number of supporting contacts 51 and that of conduction portions 72*b* may be set to be equal to each other.

It should be noted that although the conduction portions 72*b* are integrally formed with the shield plate 72, it is not necessary to form the conduction portions 72*b* integrally with the shield plate 72, or to employ the shield plate 72.

Further, although in the above-described embodiment, the contacts 5 are classified into the supporting contacts 51 and the high-frequency transmission signal contacts 52, only the supporting contacts 51 may be provide and some of them may be used as the high-frequency transmission signal contact.

It should be noted that although the ground pattern 20*c* of the FPC 20 is formed on part of the whole upper surface toward the front end 20*d* thereof, or on the whole upper surface of the FPC 20, the above-described embodiment may be configured such that the ground pattern formed on the upper surface of the FPC 20 comprises a plurality of belt-like ground patterns.

By providing conduction portions 72*b* on the pivot portions 71*d*, the ground pattern 20*c* of the FPC 20 may be connected to the holddowns 9 via the metal plate 72. Further, although FPC 20 and the printed circuit board are given as respective examples of one object to be connected and the other object to be connected, objects to be connected are not limited to these.

It is further understood by those skilled in the art that the foregoing are the preferred embodiments of the present invention, and that various changes and modification may be made thereto without departing from the spirit and scope thereof.

What is claimed is:

1. A connector comprising:

a plurality of contacts each including a contact portion which is brought into contact with a first conductor pattern formed on one surface of one object to be connected, the one object having a plate-like shape, and a connection portion which is connected to another object to be connected, the other object having a plate-like shape, said plurality of contacts including at least three supporting contacts each having a supporting portion;

a housing that holds said plurality of contacts, and has the one object to be connected inserted therein; and an operating member pivotally supported by said supporting portions of said at least three supporting contacts, for pushing the first conductor pattern of the one object to be connected which is inserted in said housing to said contact portions of said plurality of contacts, said operating member having conduction portions provided thereon for electrically connecting said supporting portions and a second conductor pattern formed on the other surface of the one object to be connected.

2. A connector as claimed in claim 1, wherein two supporting contacts of said at least three supporting contacts are disposed at opposite ends of said operating member in a longitudinal direction thereof, and others of said supporting contacts are disposed between said two supporting contacts.

3. A connector as claimed in claim 1, wherein said operating member has a metal plate disposed on a surface thereof opposed to the one object to be connected, and wherein said conduction portions and said metal plate are integrally formed.

4. A connector as claimed in claim 2, wherein said operating member has a metal plate disposed on a surface thereof opposed to the one object to be connected, and wherein said conduction portions and said metal plate are integrally formed.

5. A connector as claimed in claim 1, wherein said supporting contacts is larger in number than said conduction portions.

6. A connector as claimed in claim 2, wherein said supporting contacts is larger in number than said conduction portions.

7. A connector as claimed in claim 3, wherein said supporting contacts is larger in number than said conduction portions.

8. A connector as claimed in claim 4, wherein said supporting contacts is larger in number than said conduction portions.

9. A connector as claimed in claim 1, comprising an inserted state recognition member including a spring portion, a fixing portion which is continuous with said spring portion, and is fixed to said housing, and a swing portion which is located on a path of insertion of the one object to be connected, for being swung upward by the one object to be connected when the one object to be connected is inserted in said housing against an urging force of said spring portion, and returning to an original position via an empty space formed in the one object to be connected when the one object to be connected is completely inserted.

10. A connector as claimed in claim 2, comprising an inserted state recognition member including a spring portion, a fixing portion which is continuous with said spring portion, and is fixed to said housing, and a swing portion which is located on a path of insertion of the one object to be connected, for being swung upward by the one object to be connected when the one object to be connected is inserted in said housing against an urging force of said spring portion, and returning to an original position via an empty space formed in the one object to be connected when the one object to be connected is completely inserted.

11. A connector as claimed in claim 3, comprising an inserted state recognition member including a spring portion, a fixing portion which is continuous with said spring portion, and is fixed to said housing, and a swing portion which is located on a path of insertion of the one object to be connected, for being swung upward by the one object to be connected when the one object to be connected is inserted in said housing against an urging force of said spring portion, and returning to an original position via an empty space formed in the one object to be connected when the one object to be connected is completely inserted.

12. A connector as claimed in claim 4, comprising an inserted state recognition member including a spring portion, a fixing portion which is continuous with said spring portion, and is fixed to said housing, and a swing portion which is located on a path of insertion of the one object to be connected, for being swung upward by the one object to be connected when the one object to be connected is inserted in said housing against an urging force of said spring portion, and returning to an original position via an empty space formed in the one object to be connected when the one object to be connected is completely inserted.

13. A connector as claimed in claim 9, wherein at least said swing portion of said inserted state recognition member is positioned at an end of said operating member in a longitudinal direction, where said inserted state recognition member is visible from the outside of said housing.

14. A connector as claimed in claim 10, wherein at least said swing portion of said inserted state recognition member is positioned at an end of said operating member in a longitudinal direction, where said inserted state recognition member is visible from the outside of said housing.

15. A connector as claimed in claim 11, wherein at least said swing portion of said inserted state recognition member is positioned at an end of said operating member in a longitudinal direction, where said inserted state recognition member is visible from the outside of said housing.

16. A connector as claimed in claim 12, wherein at least said swing portion of said inserted state recognition member is positioned at an end of said operating member in a longitudinal direction, where said inserted state recognition member is visible from the outside of said housing.

* * * * *